US007850259B2

(12) United States Patent
Chen et al.

(10) Patent No.: US 7,850,259 B2
(45) Date of Patent: Dec. 14, 2010

(54) DRAWER INTERLOCKING MECHANISM APPARATUS

(75) Inventors: Wan-Lai Chen, Sanxia Township, Taipei County (TW); Tsung-Po Chang, Sanxia Township, Taipei County (TW); Tung-Lu Chang, Sanxia Township, Taipei County (TW)

(73) Assignee: Martas Precision Slide Co., Ltd., Taipei County (TW)

( * ) Notice: Subject to any disclaimer, the term of this patent is extended or adjusted under 35 U.S.C. 154(b) by 561 days.

(21) Appl. No.: 12/014,644

(22) Filed: Jan. 15, 2008

(65) Prior Publication Data

US 2009/0179534 A1 Jul. 16, 2009

(51) Int. Cl.
*E05C 7/06* (2006.01)

(52) U.S. Cl. ..... 312/221

(58) Field of Classification Search ..... 312/215–219, 312/221

See application file for complete search history.

(56) References Cited

U.S. PATENT DOCUMENTS 6,779,855 B2 * 8/2004 Hoffman ..... 312/219
7,101,001 B1 * 9/2006 Chiu ..... 312/221
7,320,507 B2 * 1/2008 White et al. ..... 312/221
7,484,817 B2 * 2/2009 Hoffman et al. ..... 312/219
7,520,576 B2 * 4/2009 Ludwig et al. ..... 312/221
2007/0040484 A1 * 2/2007 Huang ..... 312/221
2007/0182292 A1 * 8/2007 Huang ..... 312/221

* cited by examiner

*Primary Examiner*—Darnell M Jayne
*Assistant Examiner*—Matthew W Ing
(74) *Attorney, Agent, or Firm*—Schmeiser, Olsen & Watts LLP

(57) ABSTRACT

A drawer interlocking mechanism apparatus is applied where a drawer is installed inside an article. A secured plate of the present apparatus is secured at the lateral portion of the article and a sliding plate is connected the present apparatus at the lateral side of the drawer correspondingly to have the sliding plate move on the secured plate indirectly to produce the opening or closing function of the drawer. The sliding plate of the interlocking structure is installed on a single side or both sides of the drawer and also installed at a plurality of drawers in the same way. By means of a preset pull cord of the interlocking structure, a plurality of drawers are connected in series to lock the other drawers synchronously when one of drawers is opened.

6 Claims, 12 Drawing Sheets

DRAWER INTERLOCKING MECHANISM APPARATUS

FIELD OF THE INVENTION

A drawer interlocking mechanism apparatus, particularly relates to a mechanical interlocking apparatus installed among a plurality of neighboring drawers. When one of drawers is pulled open, the other drawers are locked automatically to keep unopened drawers closed tightly to smoothen the opening or closing movements of the drawers, and to prevent the risk of tilting or even falling due to the heavy loads of two drawers imposed on the cabinet body under the situation where they are opened simultaneously.

DESCRIPTION OF THE PRIOR ART

Among most storing apparatus inventions, a drawer is a well developed and pervasive apparatus. Due to the simple function and easy design of a drawer, even though the drawer has been invented for a long time, actual improvements on the function and complexity of the design are rare. Therefore it is necessary to make improvements on a conventional drawer to make it more functional.

As to a drawer, the main structure is no more than a box shaped article with an opened top. It is installed on an article, such as a cabinet, table or etc., which has a proper channel to allow a drawer to slide into. In order to operate conveniently, there is track and sliding slot installed between drawer and channel. Conventionally the track and sliding slot are made by wood. In modern industry they are replaced by metal to decrease friction and increase the smoothness of the opening or closing of a drawer. Furthermore, rolling spheres or rolling wheels are placed on the track and the sliding slot to further enhance the smoothness of the opening or closing of the drawer.

However, a conventional drawer still has shortcomings and needs to be improved. First, due to the space arrangement, most articles containing drawers are not designed with a single drawer. Instead, a number of drawers are generally arranged from top to bottom in the same article and each drawer operates independently. During the operation of multiple drawers, the operator has to open or close each drawer one by one to take out or put items into a drawer. If the operator is busy or careless, he may forget to close the opened drawer first and continue to open another drawer. Because two open drawers may be too heavy for the cabinet body, such an improper operation may easily cause the risk of the cabinet body to tilt or even to fall down and result in an accident or injury.

Furthermore, even though the operator is cautious and will not forget to close a drawer, opening or closing a single drawer may cause other non-operating drawers to slide out of the cabinet due to the vibration resulting from the large force applied on the cabinet. Such an incident is easier to occur on a drawer, which has the design of the abovementioned rolling spheres or rolling wheels installed on the track and sliding slot.

As a result, there is a need to design a structure which operates conveniently and smoothly, and automatically locks the other unopened drawers when a drawer is opened or closed to achieve stable closing. Generally, such a structure adopts the design of linkages, which connect each neighboring drawer together. When one of drawers is opened or closed, the other drawers are locked by a linkage. However, the design of linkages requires more components and is more complicated to assemble. It also increases drawer's weight, manufacturing costs and the possibility of malfunctioning. Consequently, its utility is limited. The novel structure of US patent with U.S. Pat. No. 6,779,855 adopts pull cords. Similarly, pull cords connect all neighboring drawers. When one of drawers is opened or closed, the other drawers are locked by the pull cord. However, the structure of the conventional patent is still too complicated and requires many precise parts and manufacturing costs. In addition, it is not convenient for maintenance. Especially when the fastener structure of the previous patent is not sealed properly. When the operator does not apply force properly, the pull cord may become loose causing a serious malfunction thereby making the whole drawer unusable.

In order to solve the disadvantages of the abovementioned conventional structure on a practical application, the inventor of the present invention has successfully invented a drawer interlocking mechanism apparatus based on many years of experiences in the industrial practice and development.

SUMMARY OF THE INVENTION

The primary aspect of the present invention is to provide a drawer interlocking mechanism apparatus, which is easy to operate. When a drawer is pulled open, the other drawers are locked automatically and kept unopened drawers closed tightly to prevent human negligence.

Another aspect of the present invention is to provide a drawer interlocking mechanism apparatus, which is safe to use. Only a single drawer can be opened during operation. No more than one drawer can be opened simultaneously. The operator will not be injured or the article will not be damaged as a result of the force not being applied properly by the operator or by negligence. In addition, because the unopened drawers are locked, the integrity and privacy of the contents in the drawer are assured.

Another aspect of the present invention is to provide a drawer interlocking mechanism apparatus that is low-cost and has a stable structure without altering the outer shape of the drawer or requiring a corresponding sliding slot. Besides, the present invention is an integral package and does not have many components. The manufacturing and installation is relatively easy in order to decrease the chance of malfunction. Additionally, the present invention is provided with a proper locking structure to prevent the pull cord from loosening and further increases the stability of the product.

The drawer interlocking mechanism apparatus containing the above-mentioned aspects is installed on a drawer, particularly related to a drawer driven by using secured plates and cooperating with sliding plates. A drawer is installed inside a preset channel of an article. A secured plate is installed on one side or both sides of the channel and linked with a sliding plate, which is installed on one side or both sides of the drawer correspondingly. The sliding plate and secured plate are connected via a sliding sleeve. Consequently, the sliding plate moves on the secured plate indirectly to create a function of opening or closing the drawer. The interlocking structure is installed on one side of the article or on two sides of the article concurrently based upon the quantities of the sliding plates and secured plates. Then by the same application, the sliding plates are installed at a plurality of drawers that are in the article. By using a preset pull cord of the interlocking structure, a plurality of drawers are connected in a series. When one of the drawers is open, the other drawers are locked concurrently.

In addition to the abovementioned pull cord, the interlocking structure also comprises a sliding block. The sliding block is installed inside a main case plate. The sliding block is provided with a positioning fastener. There are more than one secured fasteners installed inside the main case plate. The secured fastener and positioning fastener work together to fasten and position the pull cord in order to protect and prevent the pull cord from loosening. On the opposite side to the positioning fastener is a positioning post. A rotary disc controls the positioning post. The bottom of the rotary disc is connected to the main case plate with a rotary axis to rotate. There is also an advancing route sleeved on the positioning post. The surface of the rotary disc is further installed with a plurality of push rods.

Additionally, an inner track guiding plate is installed on the sliding plate and moves when the drawer is opened or closed. A guiding route is installed on one end of the inner track guiding plate. The guiding route is sleeved on the push rod of the rotary disc. The movement of opening or closing a drawer pushes the rotary disc to rotate synchronously. By means of the abovementioned apparatus, the pull cord becomes wedged between the secured fastener of the main case plate and the positioning fastener of the sliding block. When a drawer is pulled open, the inner track guiding plate guides the push rod by the guiding route in order to rotate the rotary disc. The rotary disc adjusts the sliding block via the positioning post due to the change of the advancing route. As a result, the positioning fastener of the sliding block is opened relative to the secured fastener and pulls the pull cord. The both ends of the pull cord then lock the other drawers synchronously.

BRIEF DESCRIPTION OF THE DRAWINGS

The drawings disclose an illustrative embodiment of the present invention, which serves to exemplify the various advantages and objects hereof, and are as follows.

DETAILED DESCRIPTION OF THE PREFERRED EMBODIMENT

Figure 1:
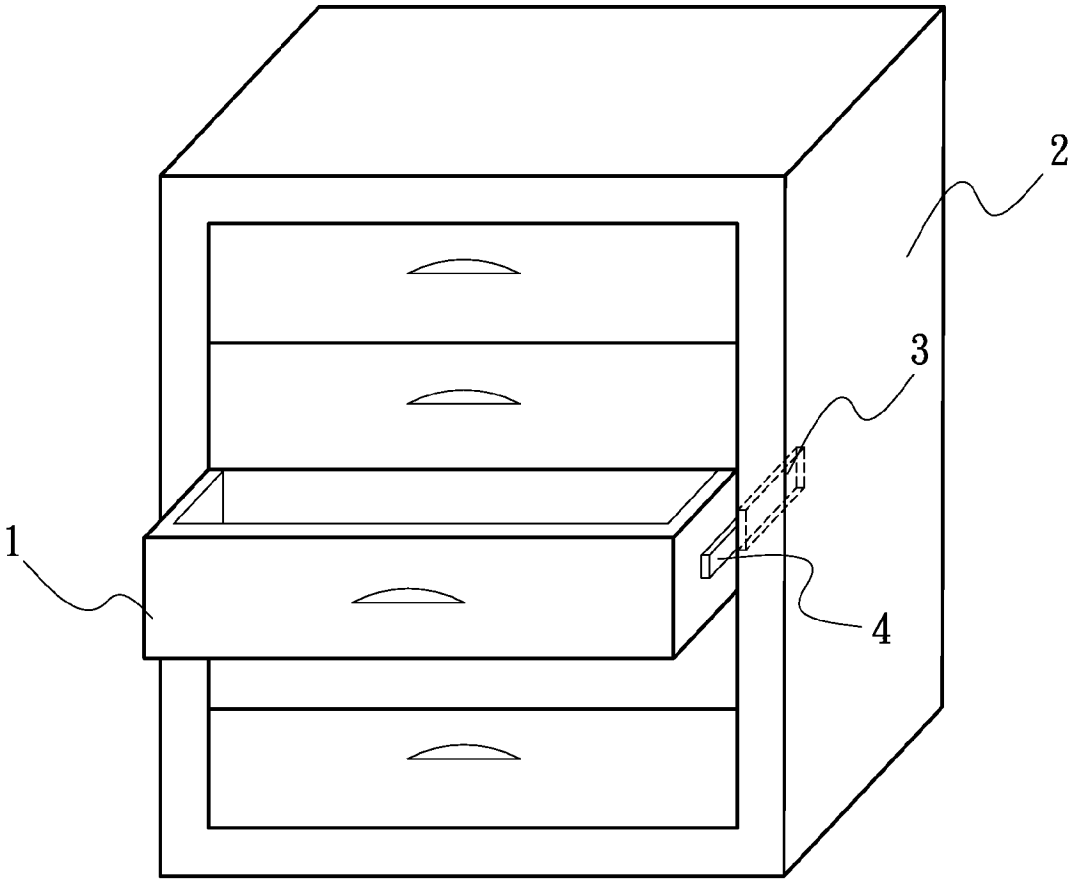
FIG. 1 is an illustrative drawing of a drawer of the present invention.

Referring to FIG. 1, the present invention relates to a drawer interlocking mechanism apparatus, which is installed on a drawer 1, particularly the drawer 1 driven by using a secured plate 3 to cooperate with a sliding plate 4. The drawer 1 is installed inside a preset channel of an article 2. The article 2 can be installed with a plurality of channels and drawers 1. The secured plate 3 is installed on the lateral side of the article 2. The sliding plate 4 is connected to the lateral side of drawer 1.

Figure 2:
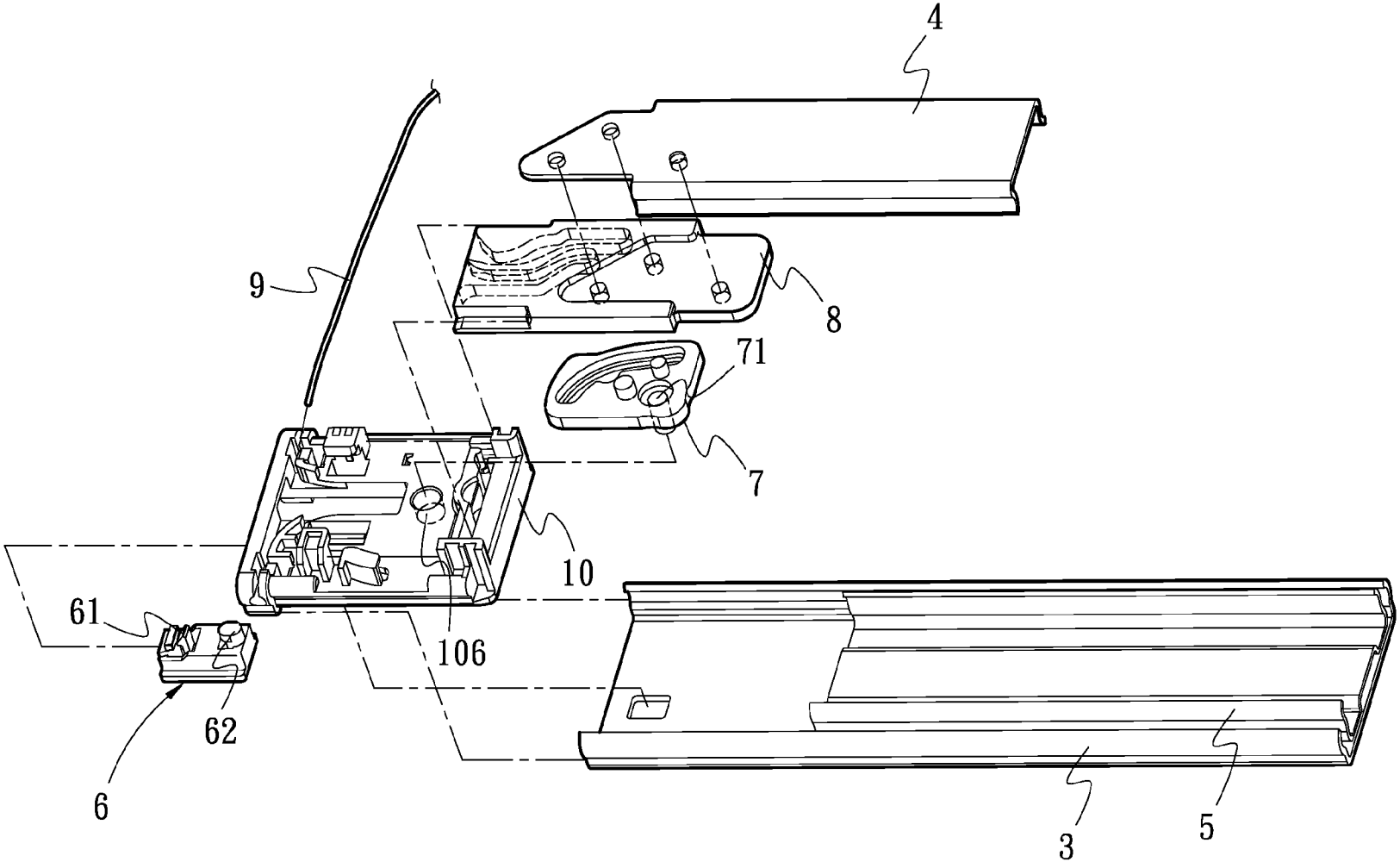
FIG. 2 is a perspective exploded view of components of the present invention.
Figure 3:
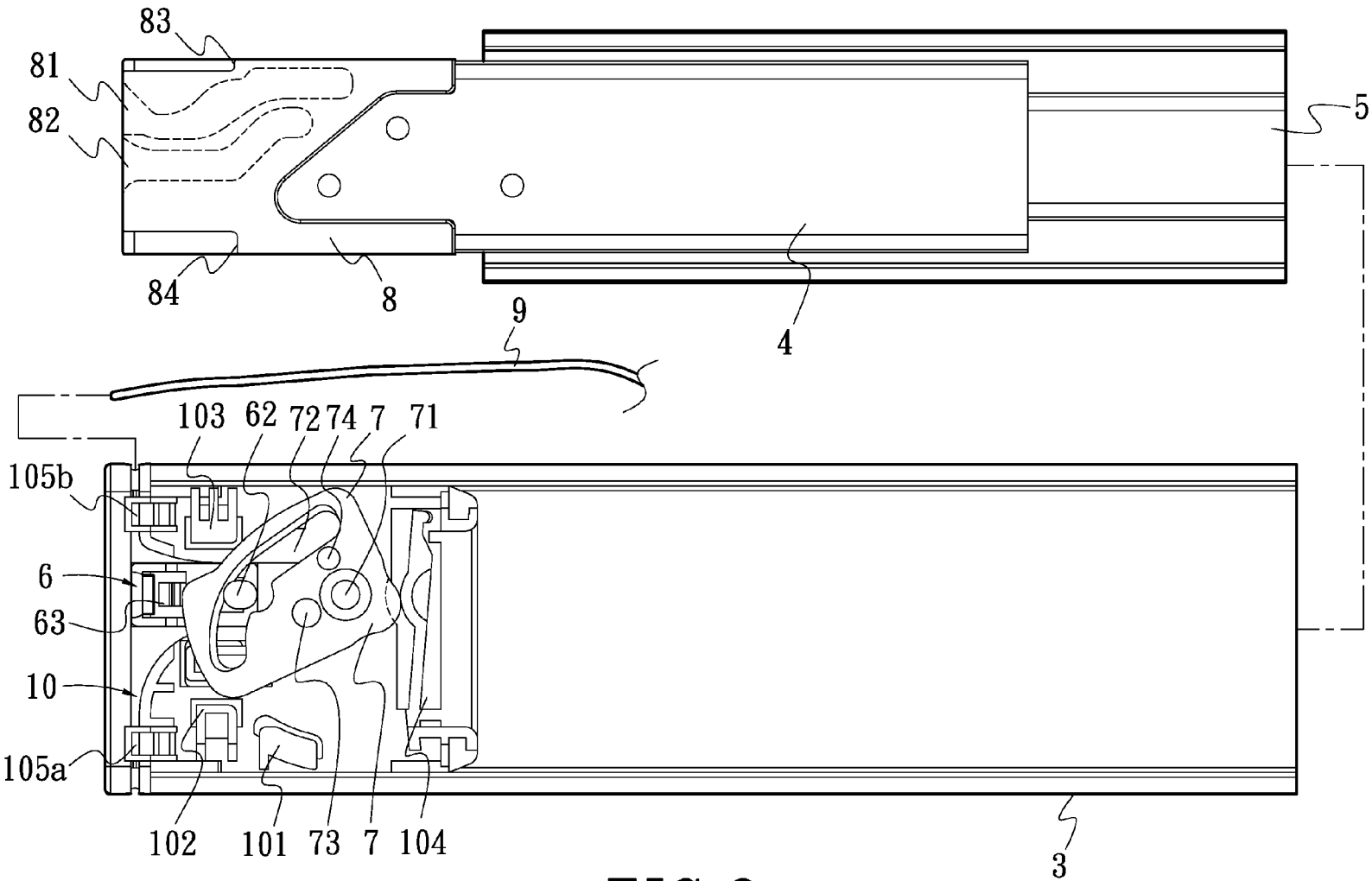
FIG. 3 is an exploded plain view of a large part of the present invention.

As shown in FIG. 2, FIG. 3 the present invention comprises a sliding block 6, a pull cord 9, a rotary disc 7 and an inner track guiding plate 8. A sliding block 6 is installed inside the main case plate 10. The sliding block 6 is also fastened and hung with a pull cord 9. Extending and retracting sliding block 6 adjusts the tightness of the pull cord 9. The sliding block 6 is also provided with a positioning fastener 61. The positioning fastener 61 fastens and positions the pull cord 9. The sliding block 6 is also provided with a positioning post 62.

The pull cord 9 is fastened on the positioning fastener 61 of the sliding block 6, and a secured fastener 105*a* and secured fastener 105*b*, which are fastened and hung on inside of the main case plate 10. The pull cord 9, the main case plate, the sliding block 6, the rotary disc 7 and inner track guiding plate 8 are installed on the secured plate 3 located at a lateral portion of the article 2.

The rotary disc 7 is composed with a rotary axis 71. The rotary axis 71 is sleeved inside the axis hole 106 of the main case plate 10 in order to rotate the rotary disc 7. The other end of the rotary disc inserts into positioning post 62. By means of rotating and controlling the sliding block 6 induces the movement of the pull cord 9. The surface of the rotary disc 7 is provided with a push rod 73 and a push rod 74.

The inner track guiding plate 8 is installed on the sliding plate 4 and moves as the drawer is opened or closed. One side of the inner track guiding plate 8 is sleeved on the push rod 73 and push rod 74. The opening or closing movement of a drawer pushes the rotary disc 7 to rotate synchronously so as to control the sliding block 6 to pull the pull cord 9.

Figure 4A:
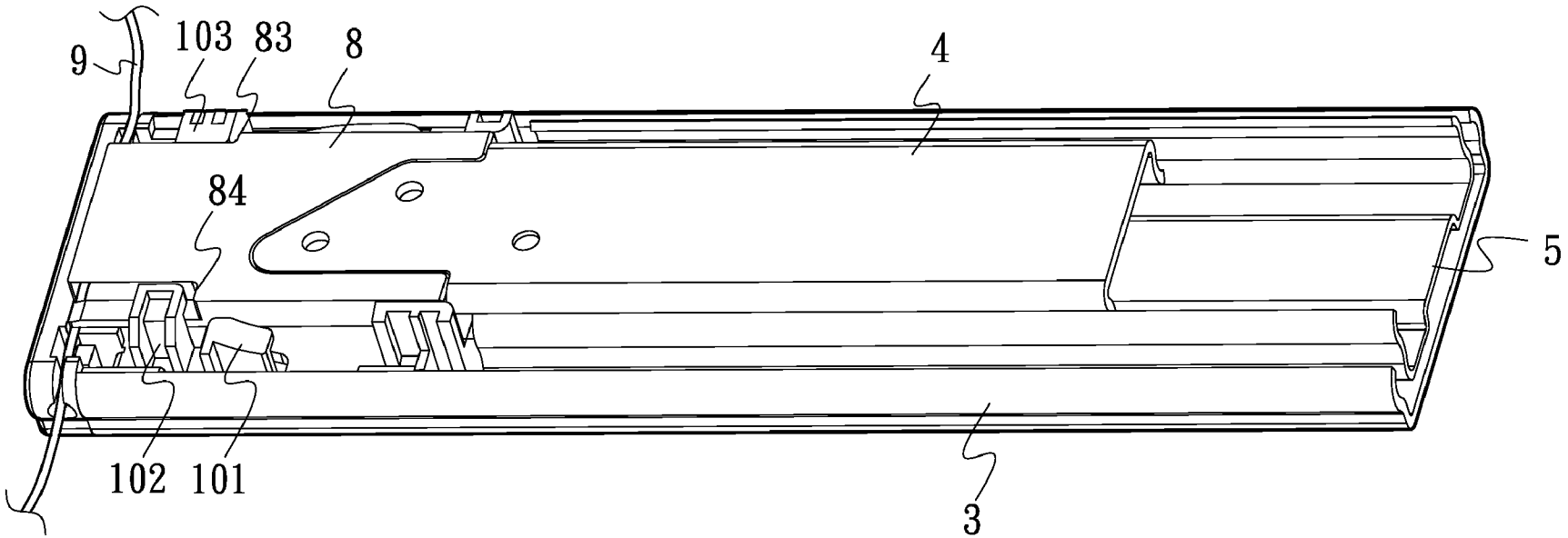
FIG. 4A to FIG. 4C are related structure perspective views of a drawer of the present invention moving from close to open.
Figure 4B:
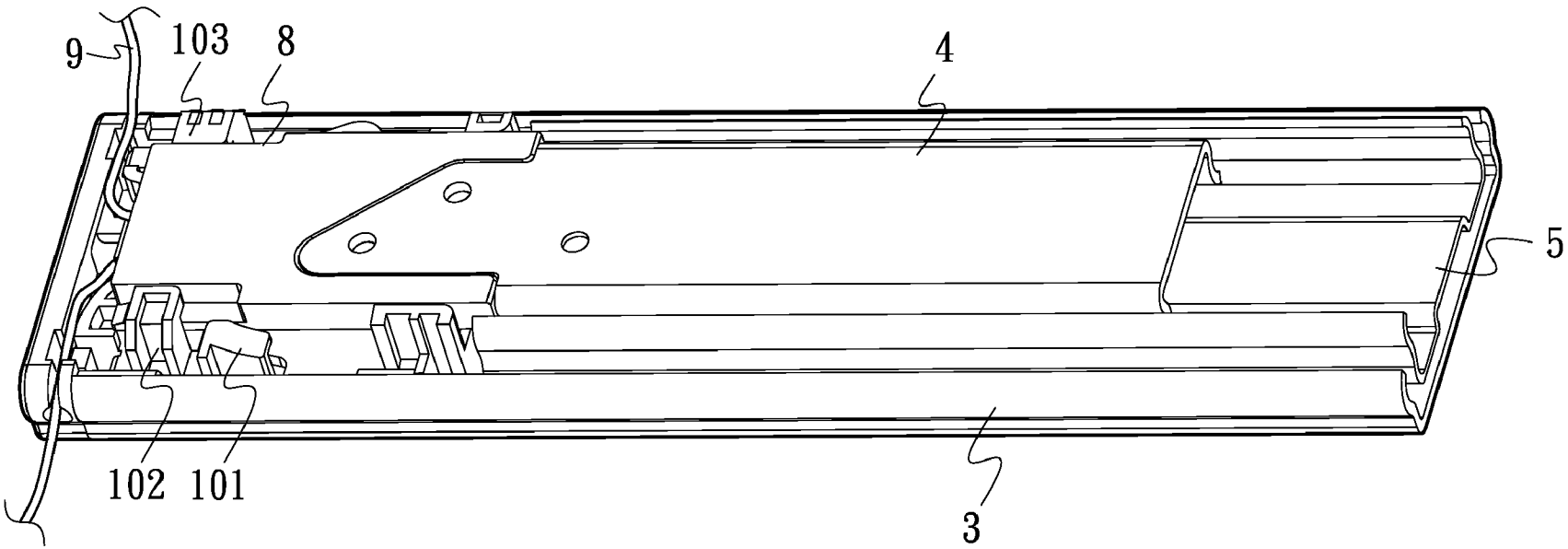
Figure 5A:
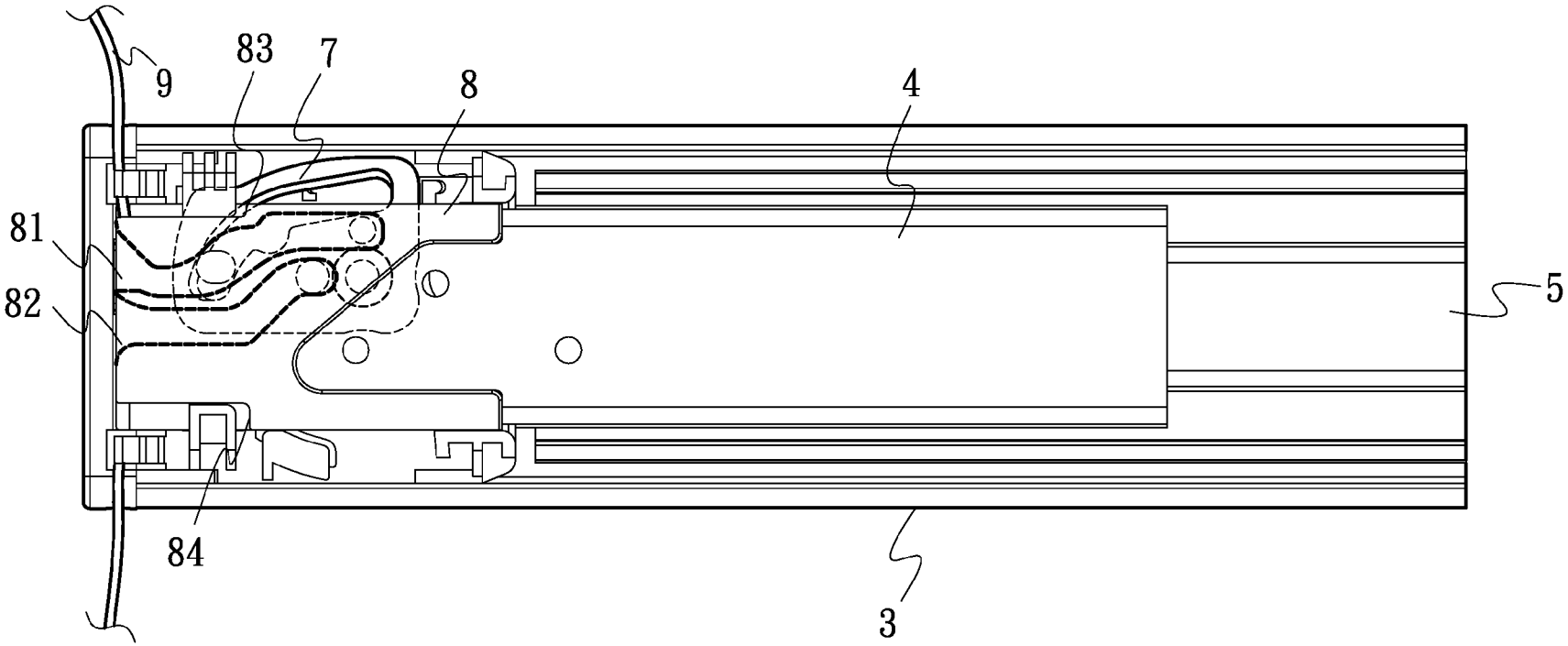
FIG. 5A to FIG. 5C are related structure plan views of a drawer of the present invention moving from close to open.
Figure 5B:
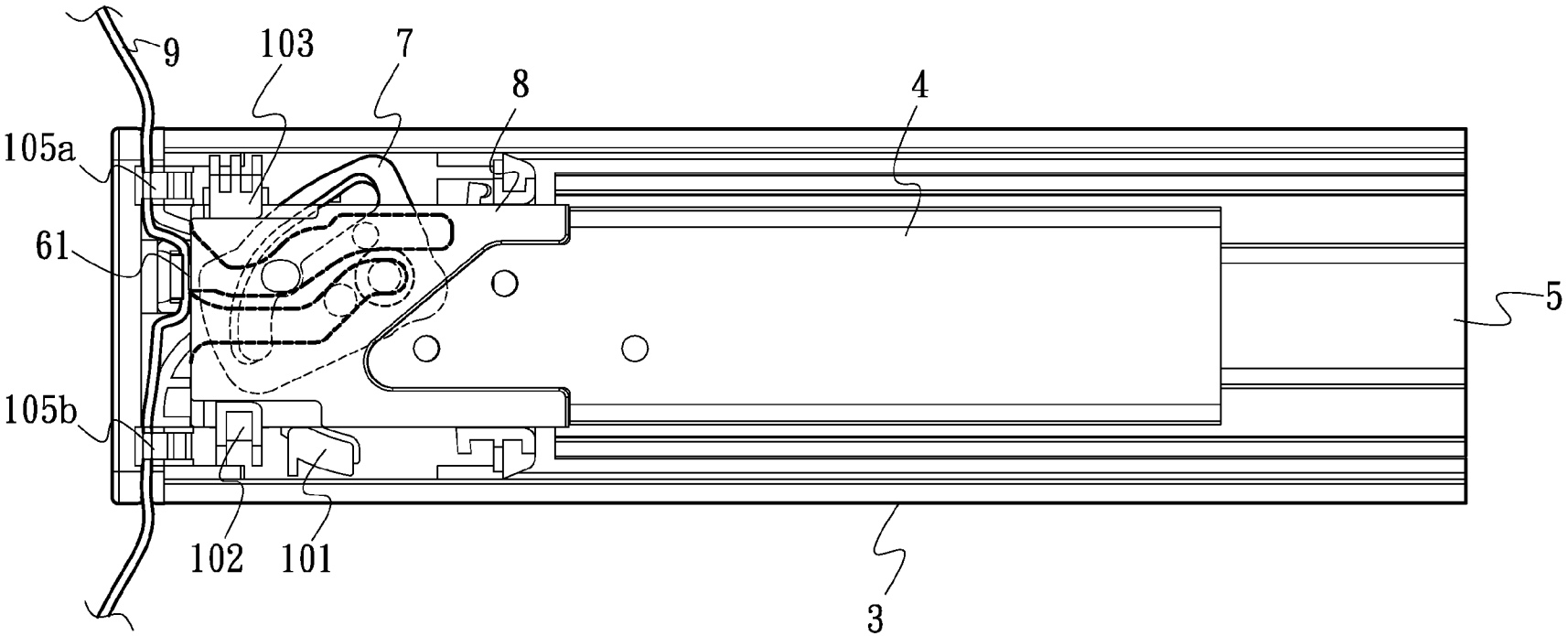
Figure 6A:
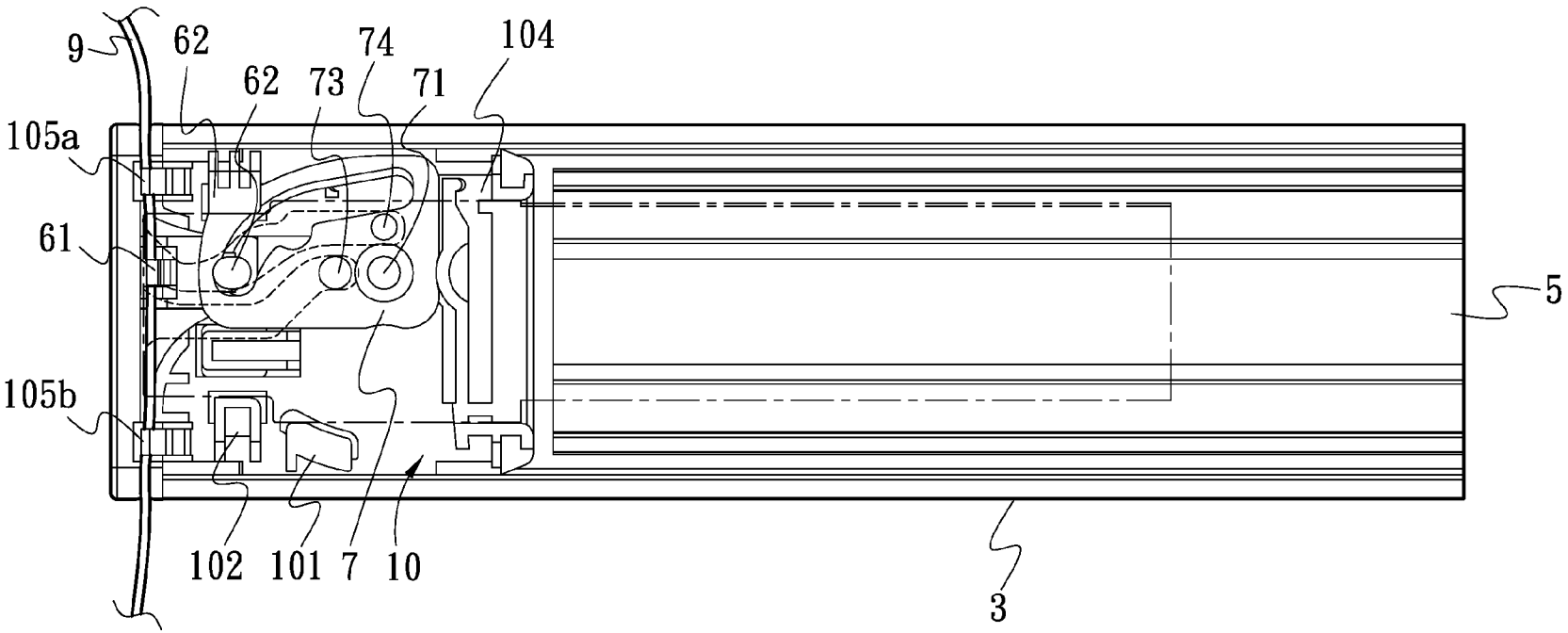
FIG. 6A to FIG. 6C are schematic internal structure views of a drawer of the present invention from close to open.

As shown in FIG. 4A, FIG. 5A, and FIG. 6A, a single side or both sides of each channel is provided with a secured plate 3, which is connected with the sliding plate 4 at both sides of drawer correspondingly. The sliding plate 4 is connected with the secured plate 3 via a sliding sleeve 5. As shown in the present embodiment, a sliding sleeve 5 is installed between the sliding plate 4 and secured plate 3 to have the sliding plate 4 and secured plate 3 transmitted indirectly via the sliding sleeve 5. The interlocking structure of the present invention is installed on a single side or both sides of the article 2 depending on the quantities of the sliding plates and secured plates. The sliding plate 4 is installed on a plurality of drawers 1 in the same way. By means of a preset pull cord 9 of the interlocking structure connects a plurality of drawers in series. When one of the drawers 1 is opened, the other drawers 1 are locked at the same time.

Figure 4C:
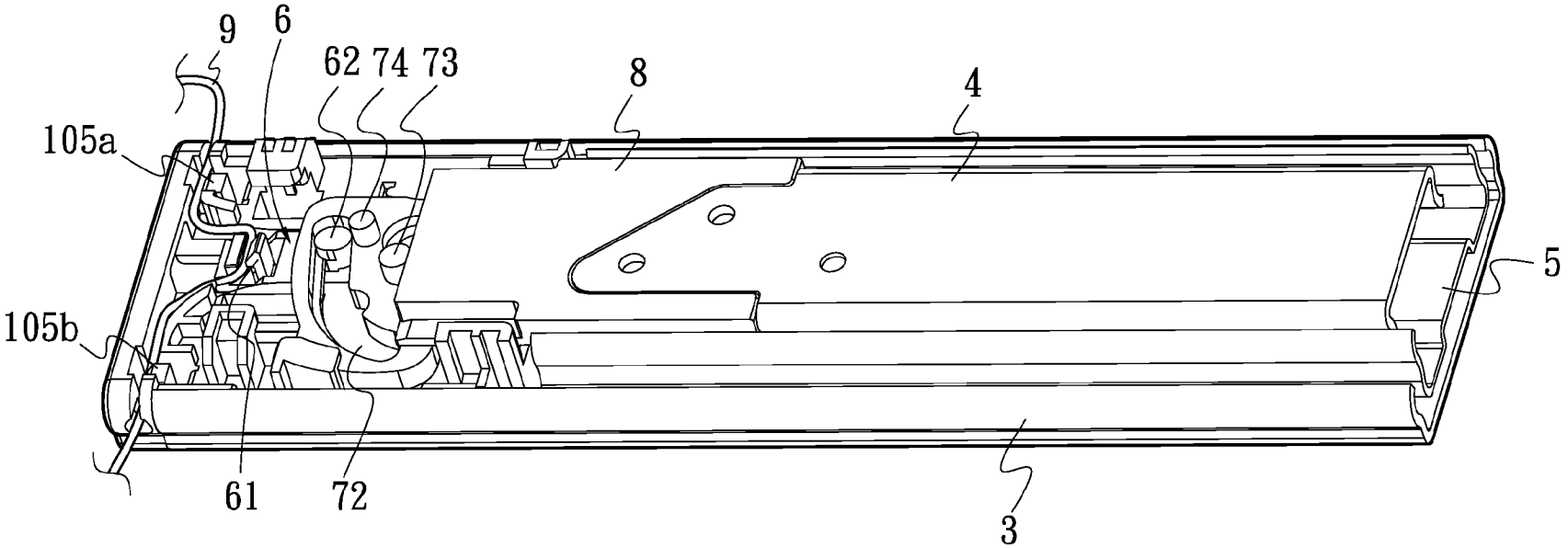
Figure 5C:
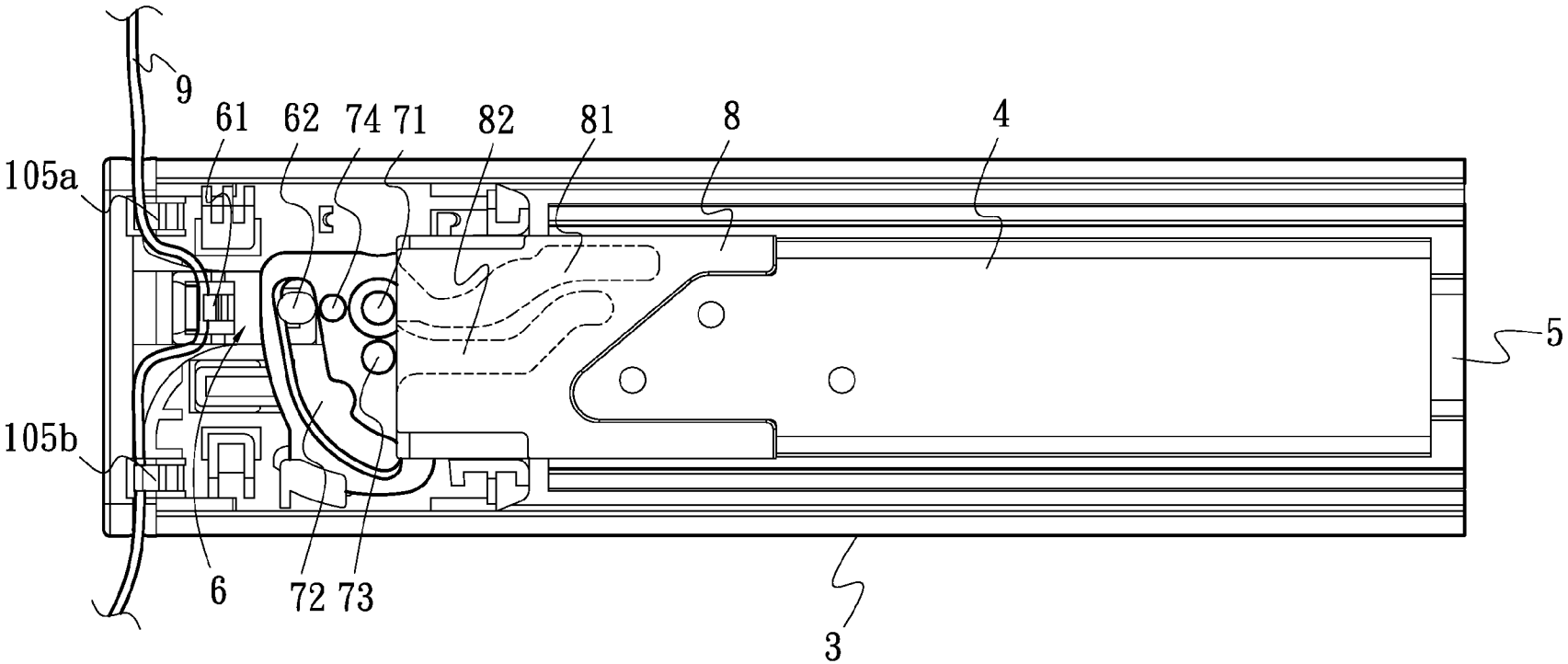
Figure 6B:
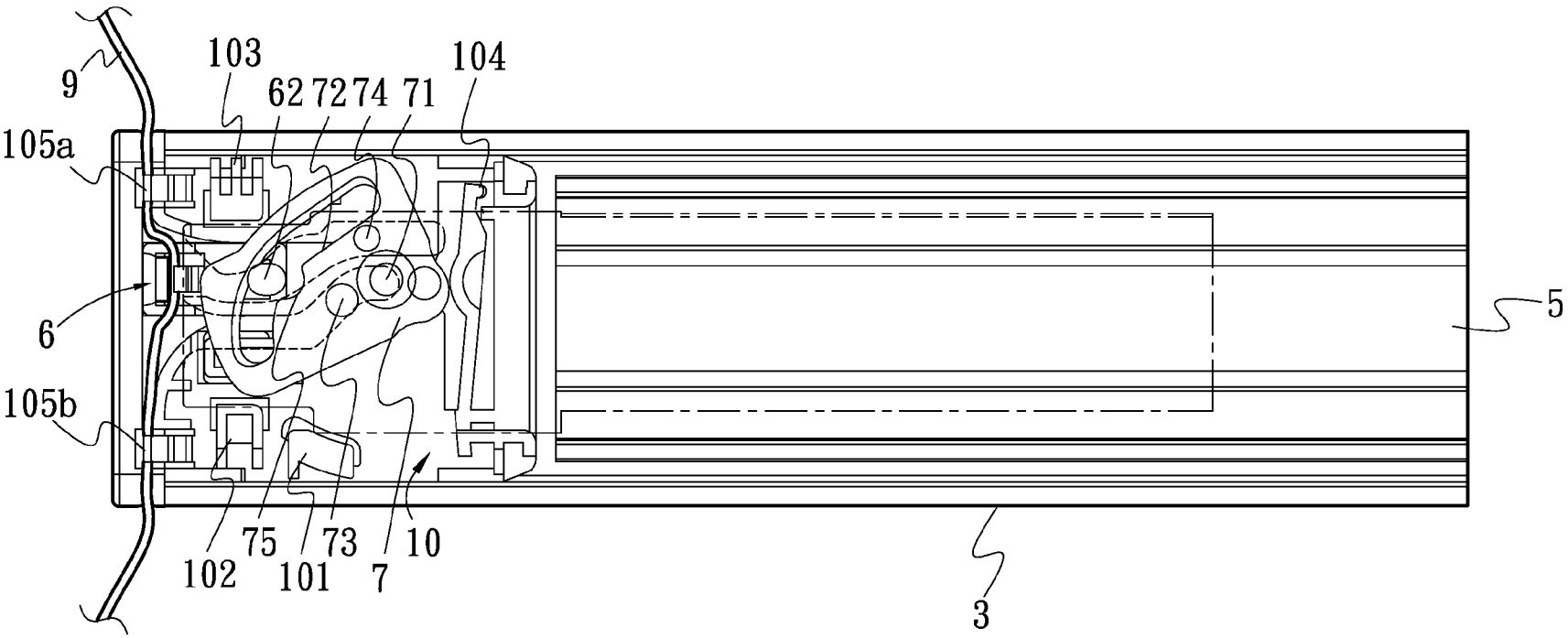
Figure 6C:
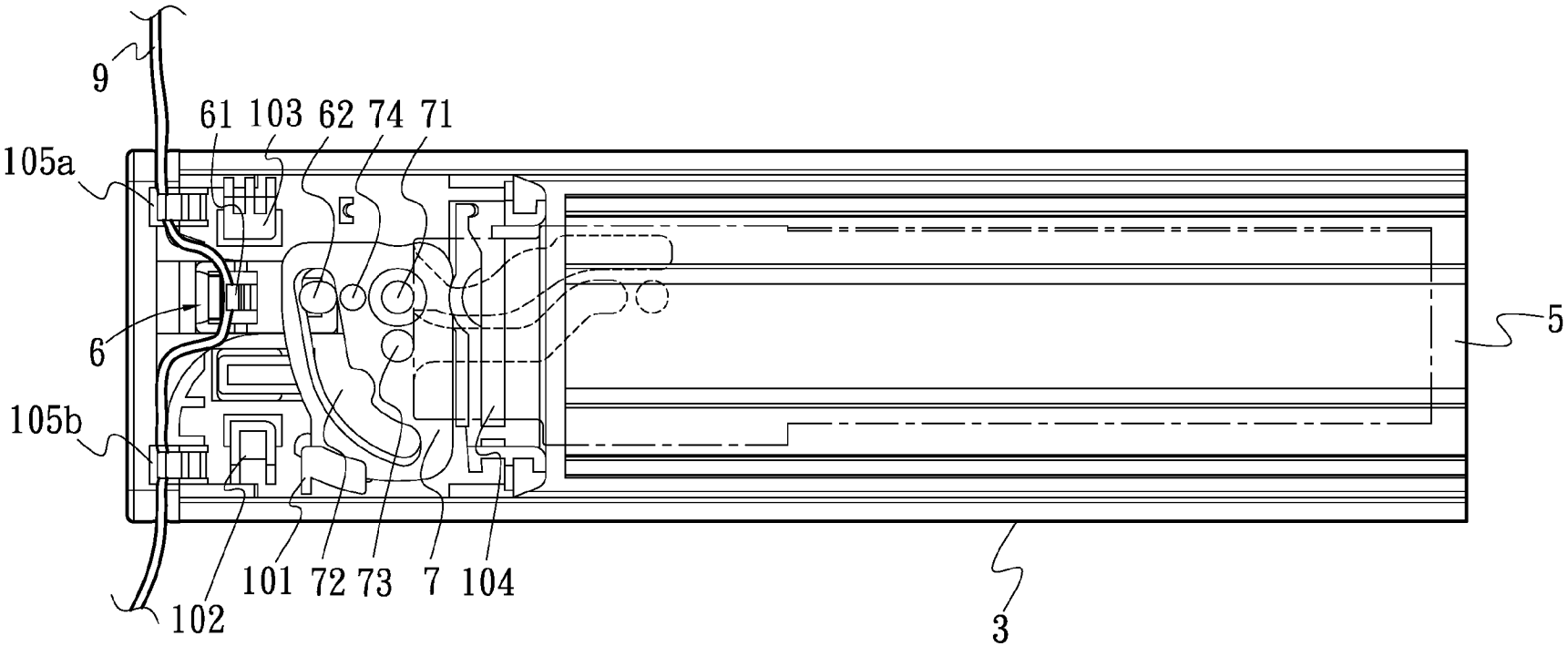

As shown in FIG. 4C, FIG. 5C, and FIG. 6C, in the abovementioned interlocking structure, the positioning fastener 61 of the sliding block 6 and the secured fastener 105*a*, 105*b* of the main case plate 10 fasten and hang the pull cord 9 between the two secured fasteners 105*a*, 105*b* and a positioning fastener 61. By means of the cooperation of the secured fastener 105*a*, 105*b* and the positioning fastener 61 protects and prevents the pull cord 9 from loosening. When the sliding block 6 moves, the positioning fastener 61 is driven and results in a change of distance between two fasteners 105*a*, 105*b* of the main case plate 10 so as to control the tightness of the pull cord 9.

As shown in FIG. 2, FIG. 5A, FIG. 5B and FIG. 5C, the positioning fastener 61 is controlled by a rotary disc 7. The bottom of the rotary disc 7 is installed on the main case plate 10 by a rotary axis 71 (as shown in FIG. 2). By means of the rotary axis 71 rotates the rotary disc 7. The rotary disc 7 is installed with an advancing route 72. The advancing route 72 sleeves the positioning post 62. The rotary disc 7 is further provided with a push rod 73 and a push rod 74. When the rotary disc 7 rotates, the rotation changes the advancing route 72 to change the position of sliding block 6 through the positioning post 62.

As shown in FIG. 3 and FIG. 6B, the advancing route 72 is provided with a slot 75. The slot 75 provides a proper space for assembling.

As shown in FIG. 2, FIG. 3, FIG. 5A and FIG. 5C, the sliding plate 4 is linked with an inner track guiding plate 8, which is moved as drawer 1 is opened or closed. The inner track guiding plate 8 is provided with a guiding route 81 and a guiding route 82. The guiding route 81 and the guiding route 82 sleeved on the push rod 73 and the push rod 74 respectively. The inner track guiding plate 8 is provided with a slot 83 and a slot 84. When the drawer 1 is closed, the inner track guiding plate 8 cooperates with the sliding block 6 to return the preset position by means of the slot 83 and the slot 84 (as shown in FIG. 5A). Furthermore, the guiding route 81 and the guiding route 82 have different width at each point. The reason is to prevent the guiding route 81 from interfering the push rod 73 and push rod 74 to assure the application of the product when the rotary disc 7 is rotated, as shown in FIG. 5A, FIG. 5B, FIG. 5C, FIG. 6, FIG. 6B and FIG. C. The width of the guiding route 81 and guiding route 82 can be adjusted depending on the size or design of drawer 1.

Referring to FIG. 1, FIG. 4C, FIG. 5B, FIG. 5C, FIG. 6A, FIG. 6B and FIG. 6C, by means of the abovementioned apparatus, this invention first fastens and hangs the pull cord 9 at the positioning fastener 61 of the sliding block 6 and connects different drawers 1 with the pull cord 9. The pull cord 9, sliding block 6, rotary disc 7, inner track guiding plate 8 and main case plate 10 are installed between the secured plate 3, which is located on both sides of the article 2, and the sliding plates 4, which is connected with the drawers 1. When the operator pulls open one of drawers 1, the drawer 1 pushes and rotates the rotary disc 7 synchronously via the inner track guiding plate 8. Resulting from the change of the advancing route 72 and advancing route 73, the rotary disc 7 adjusts the sliding block 6 via the positioning post 62 in order to open the positioning fastener 61 of the sliding block 6 and the two corresponded secured fastener 105*a* and 105*b* of the main case plate 10, and pull the pull cord 9. Accordingly, the both ends of the pull cord 9 lock the other drawers 1 synchronously. By means of controlling the predetermined extension course of the pull cord, more than one drawer 1 in the article 2 cannot be opened at the same time to assure safety. When a drawer 1 is closed via the similar means of the inner track guiding plate 8, rotary disc 7 and sliding block 6, finally the two positioning fasteners 105*a* and 105*b* approach the positioning fastener 61 relatively. At this moment the pull cord 9 is loosened and does not affect the movement of the other drawers 1.

As shown in FIG. 6A, FIG. 6B, and FIG. 6C, the main case plate 10 is provided with a positioning fastener 101, positioning fastener 102 and positioning fastener 103 respectively. When drawer 1 is opened, a protection is provided when the rotary disc 7 moves the preset position via the abovementioned positioning fasteners. Additionally, the main case plate 10 is provided with an elastic apparatus 104. The elastic apparatus 104 provides the force to reinforce the rotation of the rotary disc 7 when the rotary disc 7 is rotated to assure the reliability of the reciprocating movement.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. An article comprising a drawer interlocking mechanism apparatus, said apparatus comprising:

a main case plate, installed inside a secured plate and having a plurality of secured fasteners installed inside to fasten a pull cord and having an elastic apparatus and a plurality of positioning fasteners installed therein;

a sliding block, installed inside the main case plate and fastened and hung with a pull cord to pull the tightness of the pull cord in extension and retraction movement and having a positioning post and a positioning fastener installed at the opposite end to the positioning post;

a pull cord, fastened and hung on the positioning fastener of the sliding block and the plurality of secured fasteners inside the main case plate;

a rotary disc, the bottom of the rotary disc being installed on the main case plate with a rotary axis to rotate, one end of the rotary disc being sleeved on the positioning post of the sliding block to rotate and control the sliding block to drive the pull cord and a plurality of push rods being installed on a surface of the rotary disc; a plurality of sliding plates;

an inner track guiding plate, installed on one of said sliding plates and moving as a drawer is opened or closed, one side of the inner track guiding plate being sleeved on the plurality of push rods and pushing the rotary disc to rotate synchronously so as to control the sliding block to pull the pull cord by means of the opening or closing movement of drawer; wherein both ends of the abovementioned pull cord are connected to a plurality of drawers of an article in the same way and secured on the article respectively to lock the other drawers synchronously when one of drawers is opened, the drawers are installed in the article by means of securing the secured plates on the inner lateral portion of the article and secure the sliding plates on the drawers; the sliding plates are connected to each other by means of the sliding sleeve and the secured plate to have the sliding plates move on the secured plate indirectly to produce the opening and closing function of drawer.

2. The article as claimed in claim 1, wherein the pull cord, the main case plate, the sliding block, the rotary disc and the inner track guiding plate are installed on the secured plate located at a lateral portion of the article.

3. The article as claimed in claim 1, wherein the elastic apparatus installed on the main case plate is to reinforce the rotation force of the rotary disc; and the plurality of positioning fasteners installed on the main case plate is to provide cushion when the rotary disc arrives at a preset position.

4. The article as claimed in claim 1, wherein the rotary disc is provided with an advancing route, the positioning post is inserted into the advancing route, when the rotary disc is rotated the sliding block is adjusted via the positioning post by the change of the advancing route to control the pull cord and the advancing route is provided with a slot to provide proper space for assembling.

5. The article as claimed in claim 1, wherein the inner track guiding plate comprises a plurality of guiding routes and the plurality of push rods of the rotary disc are installed on the plurality of guiding routes to have the guiding routes move the rotary disc by means of pushing the inner track guiding plate.

6. The article as claimed in claim 5, wherein the guiding routes have different widths at each point to prevent interfering with the plurality of push rods during movement.

* * * * *